US006646256B2

(12) United States Patent
Gourley et al.

(10) Patent No.: US 6,646,256 B2
(45) Date of Patent: Nov. 11, 2003

(54) ATMOSPHERIC PRESSURE PHOTOIONIZATION SOURCE IN MASS SPECTROMETRY

(75) Inventors: Darrell L. Gourley, San Francisco, CA (US); Steven M. Fischer, Hayward, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/023,140

(22) Filed: Dec. 18, 2001

(65) Prior Publication Data

US 2003/0111598 A1 Jun. 19, 2003

(51) Int. Cl.[7] ..... H01V 49/28
(52) U.S. Cl. ..... 250/288; 250/423 R; 315/248
(58) Field of Search ..... 250/288, 423 P, 250/423 R; 315/248

(56) References Cited

U.S. PATENT DOCUMENTS 3,873,884 A 3/1975 Gabriel
4,377,749 A 3/1983 Young
4,454,425 A 6/1984 Young
4,476,392 A * 10/1984 Young ..... 250/423 R
4,574,004 A 3/1986 Schmidt-Ott et al.
4,837,484 A 6/1989 Eliasson et al.
4,960,992 A * 10/1990 Vestal et al. ..... 250/288
5,288,305 A 2/1994 Gellert et al.
5,431,714 A 7/1995 Burtscher et al.
6,049,086 A * 4/2000 Foggiato et al. ..... 250/504 R
6,130,512 A * 10/2000 Manos et al. ..... 315/248
6,343,089 B1 * 1/2002 Manos et al. ..... 372/82

* cited by examiner

*Primary Examiner*—John R. Lee
*Assistant Examiner*—Phillip A Johnston

(57) ABSTRACT

Apparatus and methods are disclosed for an ion source that comprises a flow-through ultraviolet lamp for photoionization. One embodiment of the apparatus comprises a tubular outer element and a tubular inner element. The inner element is disposed within the outer element to provide a space between the inner and outer elements. The inner element is open at its ends to provide a pathway through that element. A gas discharge between the elements produces ultraviolet radiation, which transmits through the wall of the inner element into the region within the inner element and ionizes molecules that flow through the region. The ion source can be employed in conjunction with a mass analyzer for mass spectrometry. In the method for ionizing molecules in an ion source, vaporized molecules are flowed through the region within the inner element, the region being surrounded by UV radiation. The radiation ionizes vaporized molecules in the surrounded region.

24 Claims, 4 Drawing Sheets

ATMOSPHERIC PRESSURE PHOTOIONIZATION SOURCE IN MASS SPECTROMETRY

BACKGROUND OF THE INVENTION

This invention relates to apparatus and methods for an ion source that comprises a flow-through ultraviolet lamp for production of ions for analysis by, for example, mass spectrometry.

Mass spectrometry is an analytical methodology used for quantitative and qualitative chemical analysis of materials and mixtures of materials. In mass spectrometry, a sample of a material, usually an organic or inorganic or biomolecular sample, to be analyzed called an analyte is broken into electrically charged particles of its constituent parts in an ion source. The particles are typically molecular in size. Once produced, the analyte particles are separated by the spectrometer based on their respective mass-to-charge ratios. The separated particles are then detected and a mass spectrum of the material is produced. The mass spectrum is analogous to a fingerprint of the sample material being analyzed. The mass spectrum provides information about the masses and, in some cases, quantities of the various analyte ions that make up the sample. In particular, mass spectrometry can be used to determine the molecular weights of molecules and molecular fragments of an analyte. Additionally, to some extent mass spectrometry can identify molecular structure and sub-structure and components that form the structure within the analyte based on the fragmentation pattern when the material is broken into particles. Mass spectrometry has proven to be a very powerful analytical tool in material science, chemistry and biology along with a number of other related fields.

Mass spectrometers employing ionization chambers, such as atmospheric pressure chemical ionization (APCI) chambers, have been demonstrated to be particularly useful for obtaining mass spectra from liquid or gaseous samples and have widespread application. Mass spectrometry (MS) is frequently used in conjunction with gas chromatography (GC) or liquid chromatography (LC), and combined GC/MS and LC/MS systems are commonly used in the analysis of analytes having a wide range of polarities and molecular weights. LC/MS systems have been particularly useful for applications such as environmental monitoring, pharmaceutical analysis, industrial process and quality control, and the like.

APCI may be used in conjunction with gaseous or liquid samples. In APCI-MS, in one preferred operating mode, a liquid sample containing mobile phase (solvent) and analyte is converted from liquid to vapor phase, followed by ionization of the vapor and analyte. Such systems frequently employ nebulizers, usually based on pneumatic, ultrasonic, or thermal "assists", to break up the stream of liquid entering the nebulizer into fine, relatively uniform-sized droplets, which are then vaporized. Ionization of the vaporized mobile phase and analyte molecules occurs under the influence of a corona discharge generated within the APCI chamber by an electrically conductive corona needle to which a high voltage electrical potential is applied. In APCI with liquid samples, the mobile phase molecules serve the same function as the reagent gas in chemical ionization mass spectrometry (CIMS). The mobile phase molecules are ionized by passing through a high electric field gradient or corona discharge created at the tip of the corona needle (electrode). The ionized mobile phase molecules then ionize the analyte molecules. The exact chemical reactions and resulting ions depend upon the composition of the mobile phase, whether APCI is operated in positive or negative mode, and the chemical nature of the analyte. More than one type of ion may be formed, leading to multiple mechanisms for ionization of the analyte. A fraction of the ionized analyte and solvent molecules is separated from vaporized and non-ionized solvent molecules and is subsequently focussed and analyzed by conventional mass spectrometry techniques.

Atmospheric pressure photoionization (APPI) utilizes a source of ultraviolet (UV) to ionize molecules of interest in mass spectrometry. One commonly used source is a plasma induced discharge (PID) lamp. These lamps consist of a cylindrical glass bulb filled with a noble gas such as argon, krypton, xenon, and the like. A plasma is induced in the gas via a radio frequency (RF) coil wrapped around the glass bulb, which is opaque to UV radiation. UV radiation emitted by the plasma is transmitted through a window bonded to one end of the glass cylinder. Typical window materials used to transmit the UV radiation are magnesium fluoride, calcium fluoride, lithium fluoride and so forth.

The UV radiation emitted by these lamps in the range useful in a mass spectrometer source (100 nm to 150 nm) is absorbed by air, water vapor and many of the solvents used in mass spectrometry over a short path length of a few mm. Therefore, it is necessary to locate the UV source very close to the vapor stream from the MS vaporizer. The standard PID lamp configuration often does not provide efficient illumination of the vapor molecules to produce the abundance of analyte ions desired. It is therefore desirable to provide much greater illumination of the vapor molecules.

SUMMARY OF THE INVENTION

One embodiment of the present invention is an ion source comprising (i) a vapor source, which produces a directed stream of vaporized molecules within the ion source and (ii) an apparatus for conducting photoionization within the ion source. In one embodiment the apparatus comprises a tubular outer element, a tubular inner element and a source of an electrical field. The tubular inner element is disposed within the outer element to provide a space between the outer and inner elements. The tubular inner element is open at its ends to provide a pathway therethrough. Creation of an electric field between the two elements generates a discharge in a gas contained in the space between the elements producing ultraviolet radiation, which transmits through the wall of the inner element into the space within the inner element. Molecules flowing through the space within the inner element are ionized by the UV radiation.

Another embodiment of the present invention is a method for ionizing molecules in an ion source. Vaporized molecules are flowed through a region within the ion source. UV radiation is generated to surround the vaporized molecules flowing through the region, thereby ionizing a portion of the vaporized molecules.

DETAILED DESCRIPTION OF THE INVENTION

Figure 1:
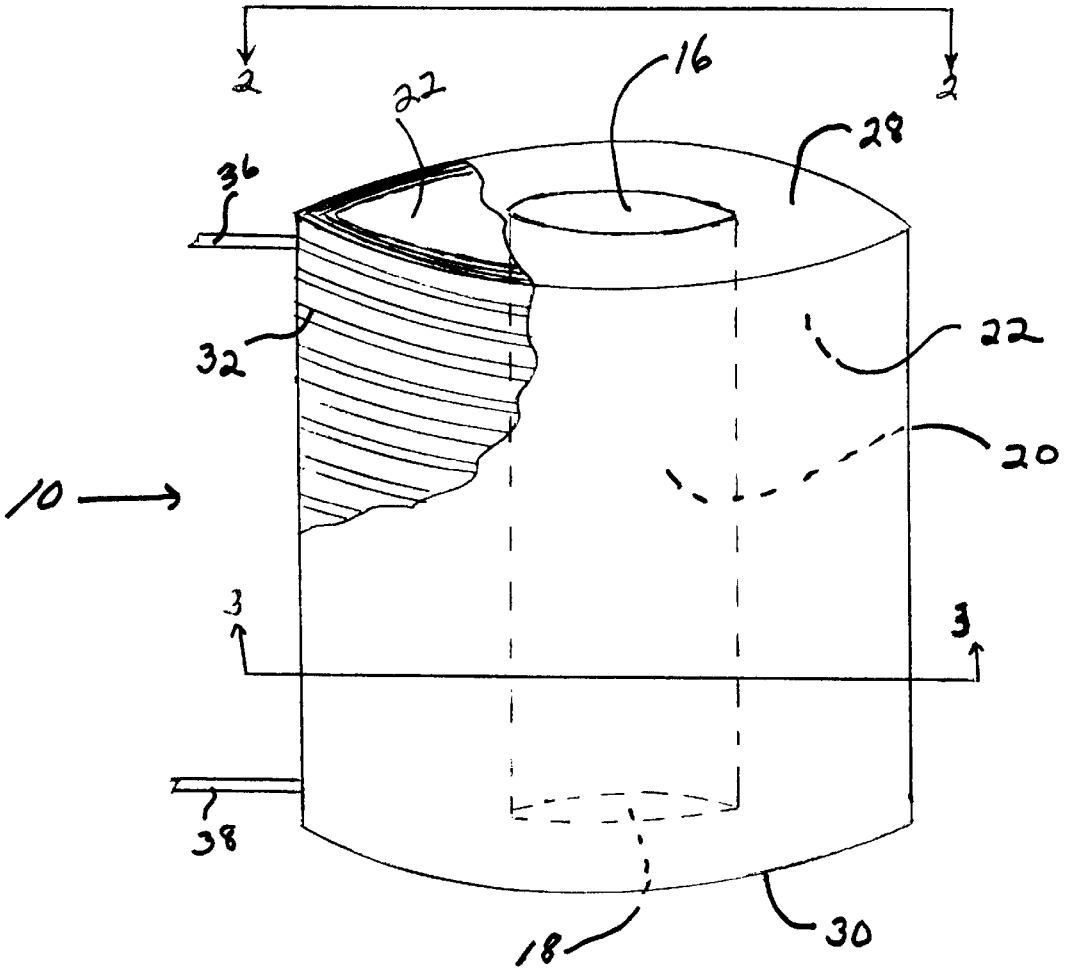
FIG. 1 is a drawing in perspective and in partial cut-away depicting an embodiment of an apparatus of the invention.

The present invention provides an ion source comprising a vapor source and a flow-through UV lamp for achieving photoionization of vaporized molecules within the ion source for use in mass spectrometry. The molecules may be vaporized under atmospheric pressure by, for example, heating and the like. While flowing through the lamp, the vaporized molecules are subjected to UV radiation, which is normally generated within a chamber of the lamp that is adjacent the area through which the vaporized molecules are flowed. The UV radiation selectively ionizes larger mass analyte molecules over smaller mass solvent molecules because of the lower ionization potential of the analyte ions. The resulting material having a higher population of analyte ions is drawn into a mass analyzer for analysis.

The lamp of the ion source of the present invention has a particularly favorable geometry for the UV radiation pattern with respect to the directed stream of vaporized molecules flowing through the lamp. The flow-through lamp of the present ion source delivers UV radiant energy that surrounds the region through which the vaporized molecules are flowed. This region is normally a cylindrical volume. With the design of the present lamp greater radiant energy may be delivered to the vaporized molecules passing therethrough as compared to that delivered by a standard PID lamp discussed above. In contrast to the present invention, the PID lamp of the art delivers UV radiant energy through an end window area and, thus, only in one direction. Less of the UV radiation from the lamp, therefore, impacts the vaporized molecules because of the limited solid angle subtended by the end window compared with that subtended by the window in the present design.

In a basic embodiment of a lamp in accordance with one aspect of the present invention, two tubular elements, also referred to herein as inner and outer elements, are disposed one within the other, thus providing a space between the two elements. The outer element is fabricated from a material that transmits an applied electrical field such as an RF field. The term "fabricated from" used herein means that the element comprises the material set forth. The element may be made wholly or partially from such material. When made partially from a material, the element may comprise layers of different materials in the form of a composite or may have supporting structures or frameworks of different materials. The materials should transmit at least 10% of the electrical field such as, e.g., RF field, usually, at least 30% of the electrical field such as, e.g., RF field. Such materials include, for example, silicon dioxide, glass materials, ceramic materials, boron nitride, aluminum oxide, corundums such as ruby, sapphire, or porcelain, and the like. Included within the terms glass materials and ceramic materials are both crystalline and amorphous dielectric materials. The inner element is fabricated from a material that is transparent to UV radiation. The material should transmit at least 20% of UV radiation, usually, at least 50% of UV radiation at the wavelengths of interest, namely, about 100 nm to about 200 nm. Such materials include, for example, magnesium fluoride, lithium fluoride, calcium fluoride, sapphire, and the like. The elements may be manufactured by techniques known in the art. Such techniques include, by way of illustration and not limitation, grinding, polishing, machining, extrusion, rolling, lithographic etching, crystal growing, and so forth.

The tubular inner element is open at its ends to provide a pathway or passageway therethrough. The tubular outer element may be sealed at its ends to provide a sealed chamber or space between the outer surface of the inner element and the inner surface of the outer element. Accordingly, a wall extends from the inner element to the outer element at each end of the present apparatus to seal the ends to the outer element.

The thicknesses of the walls of the tubular elements are independent of one another and are dependent on the particular function of the element. In general, the thickness of the wall of the outer element is dependent upon the material from which the element is fabricated. As mentioned above, one consideration with respect to the outer element of one embodiment of a lamp of the present ion source is that the longitudinal walls thereof transmit RF fields. Another consideration is the structural or mechanical integrity or stability of the outer element. The walls of the outer element should have a thickness that permits penetration, to the space between the two elements, of RF fields. Thus, the wall of the outer element should be thin enough to permit such penetration but thick enough to provide structural stability. In general, the longitudinal walls of the outer element are about 0.1 to about 10 mm, usually, about 0.5 to about 3 mm.

In general, the thickness of the wall of the inner element is dependent upon the material from which the element is fabricated. As mentioned above, one consideration with regard to the inner element is that the longitudinal walls thereof transmit UV radiation. Another consideration is the structural or mechanical integrity or stability of the inner element. The longitudinal walls of the inner element should have a thickness that permits penetration, to within the inner element, of the generated UV radiation. Thus, the walls of the inner element should be thin enough to permit such penetration but thick enough to provide structural stability. In general, the longitudinal walls of the inner element are about 0.2 to about 5 mm, usually, about 0.5 to about 3 mm.

Generally, the lengths of the elements are approximately to essentially equal. The lengths of the inner element and the outer element are each about 3 to about 100 mm, usually, about 5 to about 50 mm. The cross-sectional dimension or diameter of the inner element is dependent upon the dimensions of the pathway through which vaporized molecules are flowed, and so forth. The cross-sectional dimension or diameter of the inner element is usually about 1 to about 50 mm, more usually, about 2 to about 20 mm. The cross-sectional dimension or diameter of the outer element is dependent upon the dimensions of the inner element, the volume desired for the space between the inner element and the outer element, the volume of gas required, RF amplitude frequency, mode of coupling, gas pressure and so forth. The cross-sectional dimension or diameter of the outer element is usually about 1 to about 50 mm, more usually, about 2 to about 30 mm. The cross-sectional dimension is measured from farthest opposing points on a cross-section of the inner wall(s) of an element, e.g., the inner element. For example, for an element that has a circular cross-section, the dimension is the diameter of the circle. In another example, the inner element has a square cross-section and the dimension is measured from opposing corners of the square. For use in mass spectrometry the elements typically have dimensions that are within the smaller values in the above ranges. Thus, for use in mass spectrometry, the inner element usually has an inner cross-sectional dimension of about 1 millimeter to about 30 millimeters, usually, about 2 millimeters to about 10 millimeters.

The distance between the outer wall of the inner element and the inner wall of the outer element is, therefore, determined by the cross-sectional dimensions of the inner element and the outer element. This distance is usually about 3 to about 30 mm, more usually, about 5 to about 20 mm.

The shapes of the inner and outer elements are generally the same but need not be. The shape of each of the tubular elements may be, for example, circular, square, rectangular, elliptical, triangular, pentagonal, hexagonal and the like when viewed in the cross-section. In one embodiment, the tubular elements are cylindrical and in another embodiment the tubular elements are right circular cylindrical.

As mentioned above, the inner element is disposed within the outer element. In one embodiment, the inner element and the outer element are coaxially aligned. If the inner element and the outer element are not coaxially aligned, they are substantially coaxially aligned such that the alignment varies from coaxial by no more than about 50%, usually, by no more than about 20%.

As mentioned above, the inner element is open at its ends to provide a pathway or passageway therethrough. The outer element is usually closed at its ends to provide a sealed space between the inner and outer elements as explained above. In other words, there is an end wall at each end that runs from the wall of the inner element to the wall of the outer element to seal the space between the inner and outer elements. The outer element may be closed at its ends by means of a wall at each end that is permanently affixed to the end of the outer element in the manner described above. The end walls may be permanently affixed to the inner element and the outer element by means of adhesives such as epoxy, ceramic, silicone, and the like. In general, the thickness of the end walls is dependent upon the material from which the element is fabricated. In one embodiment, the end walls do not transmit UV radiation to any significant extent. Another consideration is the structural or mechanical integrity or stability of the sealed chamber of the present apparatus. The walls of the outer element should be thick enough to minimize such penetration and to provide structural stability. In general, the end walls are about 0.5 to about 10 mm, usually, about 1 to about 6 mm. The end walls may be fabricated from any suitable material meeting the above characteristics such as, for example, silicon dioxide, stainless steel, aluminum oxide, and so forth.

Alternatively, the ends of the outer element may be sealed by a wall that comprises a combination of flexible and non-flexible materials, which provide a friction fit of the wall with the inner surface of the outer element and the outer surface of the inner element at each end. The flexible material may be, for example, an O-ring, gasket, or other material and the like made from polyimide, TEFLON®, VITON®, KELREZ®, and the like. The non-flexible material may be a support for the flexible material and may be, for example, silicon dioxide, stainless steel, aluminum oxide, and so forth. The thickness of the non-flexible material is as discussed above for the permanently affixed end walls. In one embodiment of the present apparatus one wall at the end of the outer element may have an inlet and the wall at the other end of the outer element may have an outlet. The inlet and the outlet may be employed to introduce a gas into the space between the inner element and the outer element. Alternatively, the space may be filled with gas and sealed.

The lamp of the present apparatus also comprises a source of an electrical field for exciting the gas that is sealed in the chamber formed between the inner and outer elements. Molecules are ionized by UV radiation, which originates in a gas discharge. The gas discharge is excited by an electric field, which may be an RF field, a DC field or a microwave field. In one embodiment of a lamp for the invention, the source of the electric field is located adjacent the outer element and the inner element is free from a source of an electric field. The source of the electric field is, thus, associated with the outer element. The nature of the association is dependent on the nature of the source. Usually, the source of the electric field is external to the outer element or outside the outer wall of the outer element. The inner element is free from a source of an electric field. Accordingly, there are no electrodes, coils and the like associated with the inner element.

In the present invention, for example, an RF field is generated by coupling RF power into a coil or a capacitor that may be a pair of electrodes that can be plates, portions of cylinders, and the like. A DC field is generated by applying a DC voltage between two or more, usually, a pair of, electrodes. Normally, a high potential difference and reduced pressure are employed for glow discharge. A microwave discharge may be employed as an excitation source. A microwave field is generated by coupling microwave power to a cavity, section of transmission line, antenna, or the like. In one approach a cavity or resonant structure is used to create an RF electric field in a gas. A coupling device is generally employed in conjunction with the cavity. Examples of such cavities may be found in Review of Scientific Instruments (1965) 36:294–298 by Fehsenfeld, et al.

Accordingly, the UV source is a gas discharge. The excitation source of the discharge is an electric field. The electric field source may be a coil to which is coupled RF power, a set of electrodes to which is coupled RF or DC voltage or a cavity or section of transmission line to which is coupled microwave power. The excitation source generally is one that ultimately produces UV radiation that impinges on the inside of the tubular inner element of the apparatus through which vaporized molecules are flowed. Examples of couplings may be found in U.S. Pat. No. 3,873,884, the relevant disclosure of which is incorporated herein by reference.

In one specific embodiment, the excitation source is a source of RF voltage applied to a coupling device such as, for example, a coil of wire or the like. In one embodiment the space between the inner element and the outer element is filled with a gas capable of being activated by an RF field to produce UV radiation. The gas should be inert under the conditions of use in the present invention. Such gases include noble gases, nitrogen, and the like, and mixtures thereof. Noble gases include helium, argon, krypton, xenon, neon, and the like. The noble gases may be used individually or may be mixed with each other or with other gases such as, for example, nitrogen, and the like. The volume of the gas should be great enough to produce a sufficient amount of UV radiation when excited by the RF energy source. The UV radiation generated must be sufficient to ionize at least about $10^{-7}$ of the vaporized molecules, usually, at least about $10^{-6}$ of the vaporized molecules. The wavelength of the UV radiation generated should be about 100 nm to about 200 nm, usually, about 100 nm to about 150 nm. The volume of gas should be about 5 to about 100 microliters, usually, about 25 to about 75 microliters. Accordingly, the power delivered to the lamp is usually about 1 to about 20 watts, more usually, about 3 to about 10 watts.

In one embodiment of the present invention the inner surface of the outer element may, but need not, be coated with a material that is reflective to UV radiation. Such coatings enhance efficiency of the lamp; however, there is an increase in cost resulting from the coatings. Where a coating is employed, a portion of the UV radiation generated in the space between the inner and the outer elements is reflected through the wall of the inner element and into the flowing stream of vaporized molecules. The coating or film of material may be, for example, silicon carbide, and so forth. The coating should be as thin as possible while still achieving reflection of the UV radiation. In general, the coating should reflect at least about 10%, usually, about 30%, of the UV radiation. Usually, the thickness of the coating is about 1 to about 100 micrometers, more usually, about 5 to about 20 micrometers. The coating may be applied by techniques well known in the art such as, for example, vacuum sputtering, chemical vapor deposition, physical vapor deposition, and the like.

As mentioned above, an RF voltage or current is used to generate an RF field within the gas in the space between the inner and the outer elements, which results in the production of a plasma. The plasma emits UV radiation at a predetermined wavelength. In one embodiment the outer element is wrapped with a coil for generating RF energy. The coil may be similar to one that is typically used in plasma-induced discharge lamps that are known in the art. For a more detailed discussion of such RF coils, see, for example, U.S. Pat. No. 3,873,884, the relevant disclosure of which is incorporated herein by reference. The size of the coil and the like is determined by the amount of RF energy required to produce the desired plasma for generating UV radiation. In general, the amount of RF energy is that sufficient to produce and maintain the gas discharge and to, thus, generate the desired amount of UV radiation. Determining the amount of RF energy from the desired amount of UV radiation is well within the skill of one in the art. Typical amounts are about 1 to 100 watts, but amounts above and below such range are possible. The amount of RF voltage applied is dependent on the nature of the specific geometry, dimensions including length, diameter, etc., of the discharge chamber, gas pressure and so forth. Specific amounts may be readily determined by the skilled artisan.

In the above embodiment a third element may be disposed around the outer element. Preferably, the third element is fabricated from a material that shields the coil, i.e., a material that provides RF shielding. The material should provide a level of RF shielding of at least about 10 dB, usually, at least about 40 dB. In general, the thickness of the third element is dependent upon the material from which the element is fabricated. Another consideration is the structural or mechanical integrity or stability of the element itself. The third element should have a thickness that provides sufficient shielding for the RF coil so as to prevent or substantially minimize undesired leakage of RF energy. In general, the end walls of the third element are usually about 0.5 to about 10 mm, more usually, about 1 to about 6 mm. The material from which the third element is fabricated may be any conductive material such as, for example, a metal, e.g., iron; metal alloy, e.g., mumetal; conductive plastic or polymer; and so forth, or it may be a conductive layer or film deposited on another material or a sandwich arrangement and the like. The third element has appropriate openings through which leads that connect the RF coil to an RF voltage source may pass. The openings should be only as wide to permit the leads to pass therethrough while narrow enough to prevent transmission of the RF field. The openings may be sealed with a suitable sealing material. It should be noted that the use of an RF coil is by way of illustration and not limitation. In general, any mode for achieving coupling of RF energy to the discharge gas may be employed including direct contact probes, induction, capacitive coupling, resonant cavity, and so forth.

Figure 2:
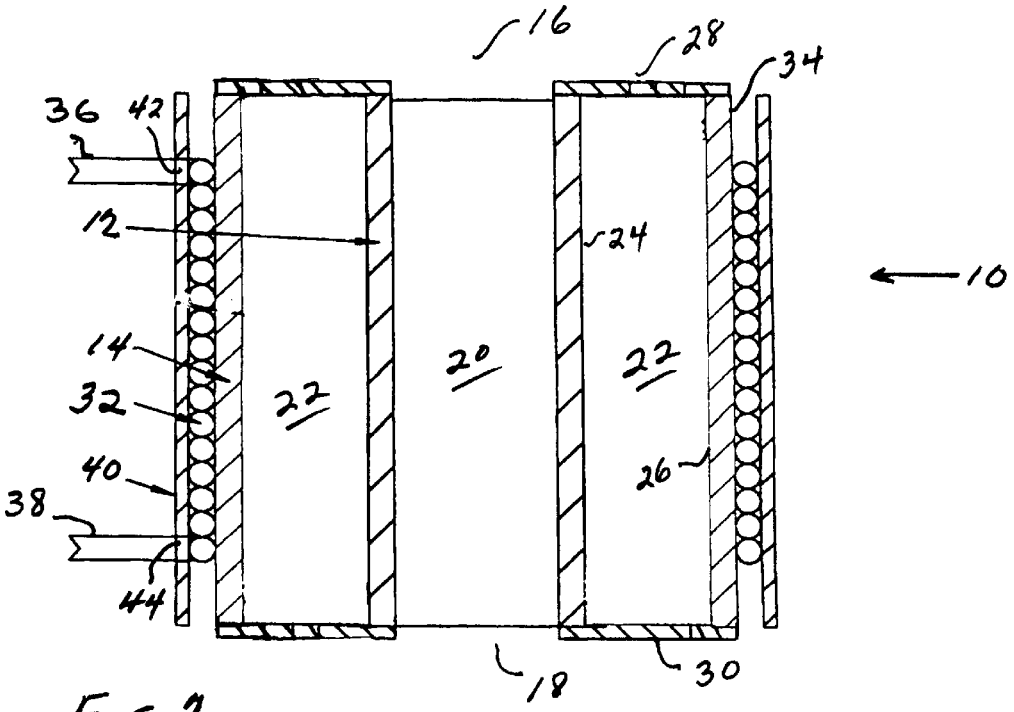
FIG. 2 is a vertical cross-section of the embodiment of FIG. 1 taken along lines 2—2.
Figure 3:
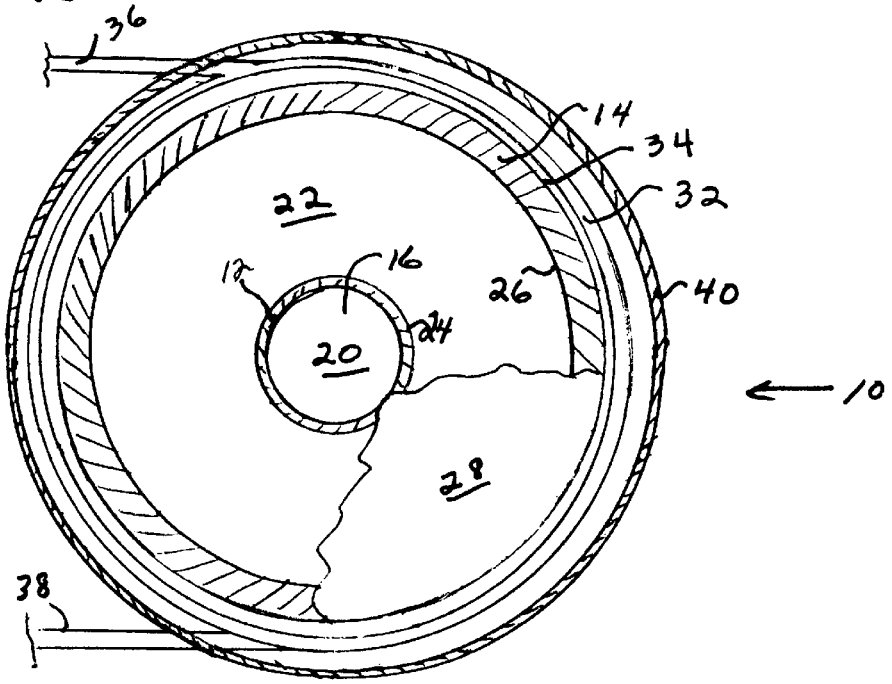
FIG. 3 is a horizontal cross-section and partial cut-away of the embodiment of FIG. 1 taken along lines 3—3.

An embodiment of an apparatus for use in, and in accordance with, the present invention is depicted in FIGS. 1–3, by way of illustration and not limitation. Apparatus 10 is depicted and comprises inner element 12 and outer element 14. Inner element 12 is open at ends 16 and 18 to form passageway 20 through the interior of inner element 12. Annular space 22 lies between outer surface 24 of inner element 12 and inner surface 26 of outer element 14. Walls 28 and 30 are found at each end of outer element 14 and seal annular space 22 at both ends to form a sealed chamber, which normally contains a gas as discussed above. Walls 28 and 30 extend inwardly from outer element 14 to inner element 12. RF coil 32 is wound around the outer surface 34 of outer element 14. Leads 36 and 38 provide for connection of RF coil 32 to a suitable RF voltage source (not shown). Surrounding RF coil 32 is third element 40, which provides a shield for RF coil 32. Third element 40 has appropriate openings 42 and 44 through which leads 36 and 38 pass.

Figure 4:
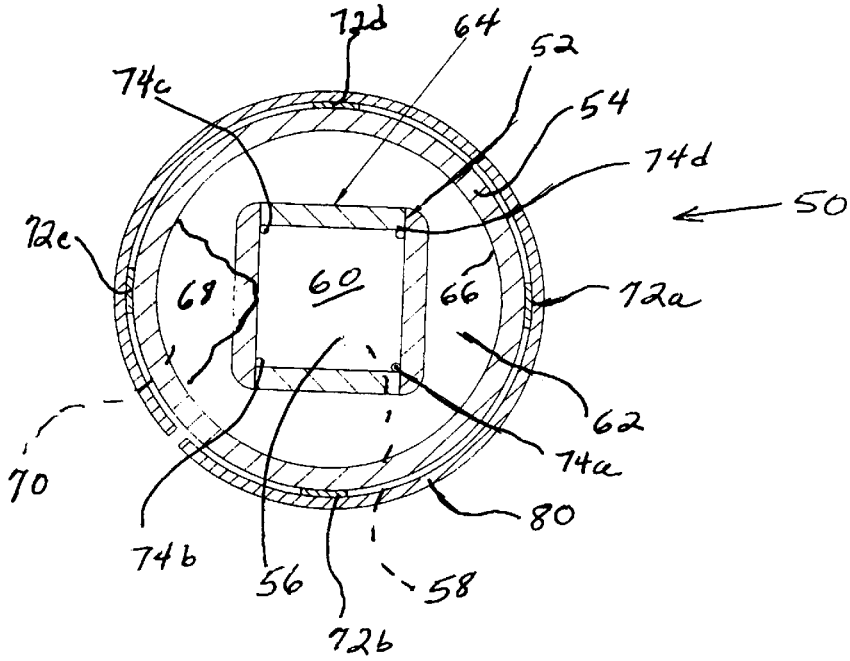
FIG. 4 is a horizontal cross-section of another embodiment of an apparatus in accordance with the present invention.

Another embodiment of an apparatus for use in, and in accordance with, the present invention is depicted in FIG. 4, by way of illustration and not limitation. Apparatus 50 is depicted and comprises inner element 52 and outer element 54. Inner element 52 is open at ends 56 and 58 to form passageway 60 through the interior of inner element 52. Annular space 62 lies between outer surface 64 of inner element 52 and inner surface 66 of outer element 54. Walls 68 and 70 are found at each end of outer element 54 and seal annular space 62 at both ends to form a sealed chamber, which normally contains a gas as discussed above. Walls 68 and 70 extend inwardly from outer element 54 to inner element 52. Four insulated electrodes 74*a*–74*d* are positioned in passageway 60. Four insulated electrodes 72*a*–72*d* are positioned in the space between outer element 54 and a third element 80. Insulated electrodes 74*a*–74*d* extend out of the ends 56 and 58 of the passageway 60 and are connected to one polarity of an RF voltage generator. Insulated electrodes 72*a*–72*d* extend out of the ends of the annular space between the outer element 54 and the third element 80, and are connected to the opposite polarity of an RF voltage generator. When activated, the RF voltage between 74*a*–74*d* and 72*a*–72*d* produces an electric field within the annular space 62 containing the gas as discussed above.

Figure 5:
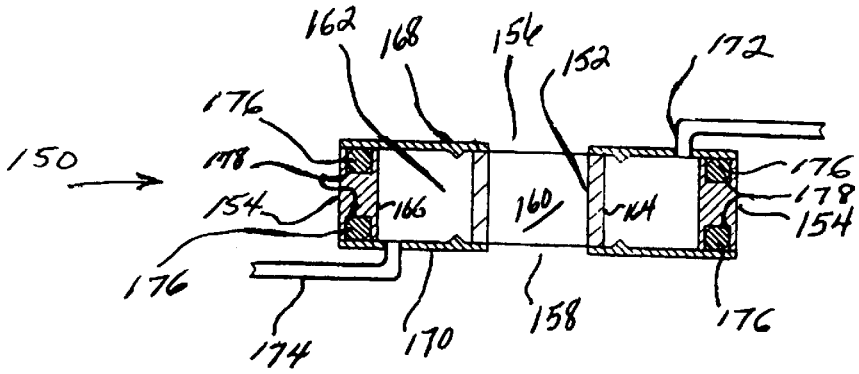
FIG. 5 is a vertical cross-section of an alternate embodiment of an apparatus in accordance with the present invention.

An embodiment of an apparatus for use in, and in accordance with, the present invention is depicted in FIG. 5, by way of illustration and not limitation. Apparatus 150 is depicted and comprises inner element 152, which may be a magnesium fluoride tube, and outer element 154. Inner element 152 is open at ends 156 and 158 to form passageway 160 through the interior of inner element 152. Annular space 162 lies between outer surface 164 of inner element 152 and inner surface 166 of outer element 154. Walls 168 and 170 are found at each end of outer element 154 and seal annular space 162 at both ends to form a sealed chamber, which normally contains a gas as discussed above. Walls 168 and 170 extend inwardly from outer element 154 to inner element 152 and are in the form of electrodes. O-ring seals 176 are in recesses 178 in outer element 154. Apparatus 150 further comprises gas fill tubes 172 and 174 for introducing gas into annular space 162. Appropriate electrical leads (not shown) connect electrode walls 168 and 170 to a DC electrical source to produce a DC discharge.

One embodiment of the present invention is a method for ionizing molecules in an ion source. The molecules are vaporized under atmospheric pressure in the ion source and flowed in a directed stream through a region. The vaporized molecules flowing through the region are subjected to the UV radiation surrounding the region to ionize the vaporized molecules. The source of the UV radiation is external to the region.

In one embodiment, the region is found in an apparatus as described above. Molecules are vaporized under atmospheric pressure by means known in the art, e.g., as described below. The vaporized molecules are flowed through a tubular inner element of an apparatus comprising (i) a tubular outer element, (ii) a tubular inner element, (iii) a source of an electrical field such as, e.g., an RF field for exciting gas, and optionally (iv) a third element disposed around the outer element to provide an annular space therebetween. The source of the electrical field may be confined in the aforementioned annular space. The inner element may be coaxially disposed within the outer element to provide a second annular space. The second annular space may be sealed and have a gas contained therein. The inner element is open at its ends to provide a pathway therethrough.

The present invention has particular application to mass spectroscopy including mass spectrometry wherein a mass spectroscope and appropriate measuring devices are included. A mass spectroscope having an ion source in accordance with the invention comprises a source of vaporized molecules, which may include a source of molecules such as that typically employed in APCI mass spectrometry. In one embodiment the source may be the effluent from a GC, which is already in gaseous or vaporized form. In another embodiment a liquid sample is vaporized. The liquid sample may be from any source thereof customarily employed in conjunction with mass spectroscopy. Thus, for example, the source may be effluent from LC or other separation technique, flow injector, syringe pump, infusion pump.

In APCI-MS, in one operating mode, a liquid sample containing mobile phase (solvent) and analyte is converted from liquid to vapor phase. Such systems frequently employ nebulizers, optionally with pneumatic, ultrasonic, or thermal "assists", to break up the stream of liquid entering the nebulizer into fine, relatively uniform-sized droplets, which are then vaporized.

To assist in vaporizing liquid sample molecules, the material is often heated to a temperature that is sufficient to achieve vaporization of the molecules. In general, the temperature at which the sample molecules are heated is about 100 to about 500° C., usually, about 250 to about 400° C.

In the ion source of the present invention, the vapor molecules are allowed to flow through the inner element of an apparatus that comprises the inner element, an outer element, and a gas discharge for producing ultraviolet radiation within a space between the inner element and the outer element. UV radiation of appropriate wavelength and intensity is generated in the apparatus of the invention and transmitted through the inner element thereof to the region through which the vapor molecules are flowed. As explained above, the UV radiation selectively ionizes larger mass analyte molecules over smaller mass solvent molecules. The above-described apparatus is adjacent the source of vaporized molecules and is usually positioned at the exit of such source. It is desirable to minimize the distance between the source of vaporized molecules, or vapor source, and the entry into the inner element of the present device. The distance is usually about 0 to about 20 mm, more usually, about 1 to about 10 mm.

All or a major fraction of the ionized analyte molecules exiting from the aforementioned apparatus are analyzed by conventional mass spectrometry techniques. Accordingly, the mass spectrometer of the invention further comprises a mass analyzer adjacent the apparatus. In general, the aforementioned apparatus may be utilized in mass spectrometry applications where generation of ions is carried out as part of the mass spectrometric analysis. The mass analyzer may be a mass spectrometer such as, by way of example and not limitation, time-of-flight (TOF), ion trap, quadrupole or multipole, magnetic sector, Fourier-Transform (FT), Ion Cyclotron Resonance (ICR), sector (magnetic/electric) and the like. The detector of the mass analyzer is usually a device for recording ions that are subjected to acceleration and deflection forces in mass spectrometry, as is commonly known in the art. The nature of the detector is dependent on the type of mass analysis. Ideally, the detector must have high sensitivity and high dynamic range as well as providing good temporal resolution. A number of different detector types are used in mass spectrometers. Among these are the channeltron, Daly detector, electron multiplier tube, Faraday cup and microchannel plate and also hybrid electron multiplier detectors.

Figure 6:
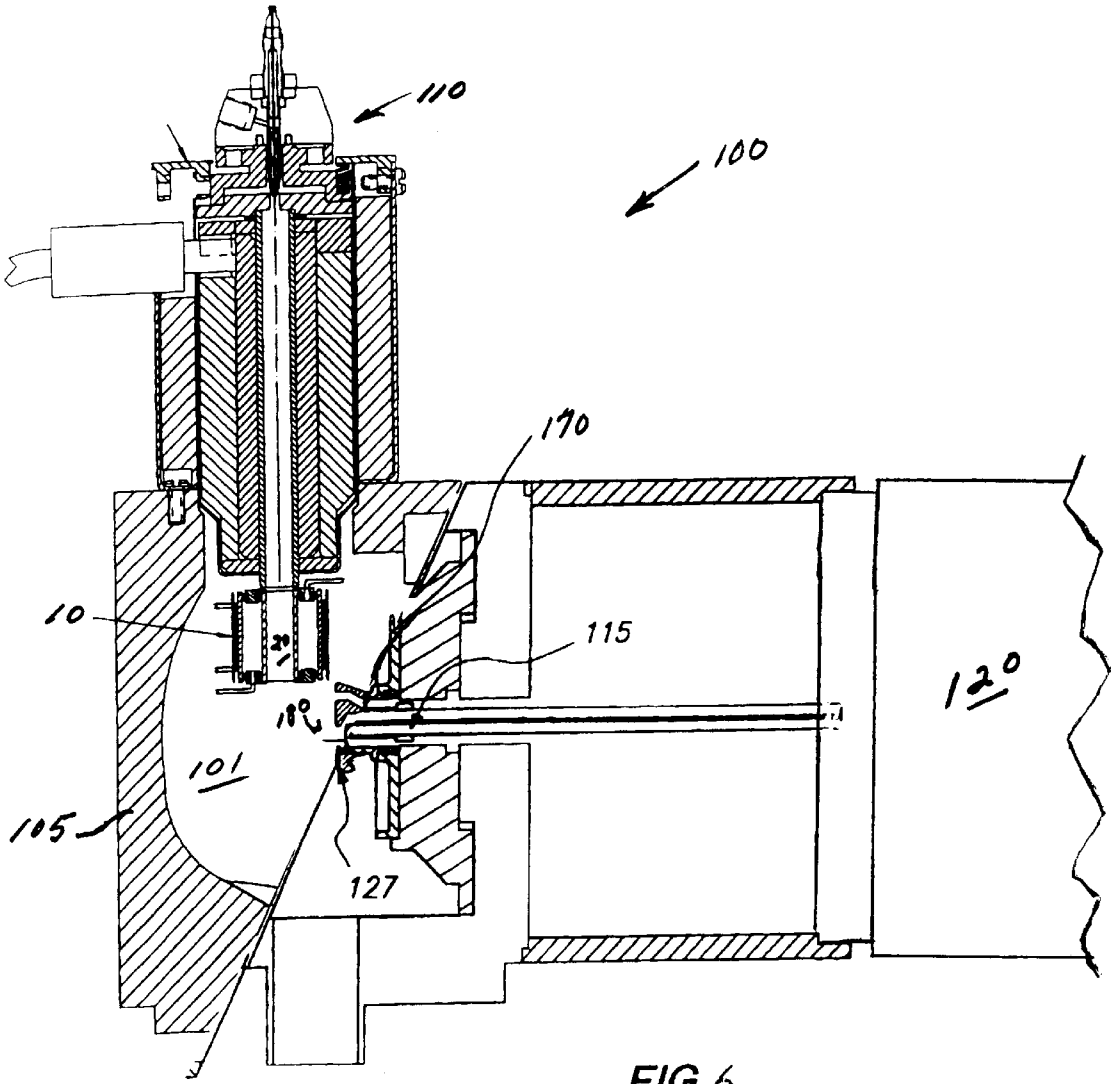
FIG. 6 is a diagrammatic sketch of a mass spectrometry apparatus, which comprises the apparatus of FIG. 1.

A mass spectrometry apparatus 100 that employs an apparatus 10 of the invention is depicted in FIG. 6 by way of illustration and not limitation. Chamber 101 comprises a housing 105 containing at least one region to which ions are emitted from passageway 20 of apparatus 10, optionally a nebulizer/vaporizer assembly 110 for vaporizing samples, optionally a capillary assembly 115 for communicating to a mass analyzer 120. Nebulizer/vaporizer assembly 110 and capillary assembly 115 are shown arranged in a substantially orthogonal or cross-flow configuration. In such orientation the angle between the axial centerlines of nebulizer/vaporizer 110 and capillary assembly 115 is preferably between about 75 degrees and about 105 degrees, more preferably at or about 90 degrees. It should be noted that other configurations are possible such as orientations that are substantially linear (axial), angular, off-axis and the like.

Chamber 101 may be fabricated from any material providing the requisite structural integrity and which does not significantly degrade, corrode, deform or outgas under typical conditions of use. Typical materials for fabricating chamber 101 include, for example, metals such as stainless steel, aluminum and aluminum alloys, glass, ceramics and plastics such as, e.g., Delrin acetal resin (trademark of DuPont) and Teflon fluorocarbon polymer (trademark of DuPont). Composite or multilayer materials may also be used. In a preferred embodiment, housing 105 is fabricated from an aluminum alloy with a coating such as a TEFLON® coating.

The nebulizer assembly 110 is typically fabricated from stainless steel or the like and heated by, for example, a resistance heater around the vaporizer tube. The vaporizer is usually fabricated from aluminum oxide and is typically heated as discussed above. The capillary assembly 115 is typically fabricated from borosilicate glass such a Pyrex glass (trademark of Corning).

With reference to FIG. 6, during operation, a liquid sample containing analyte is nebulized and vaporized in nebulizer/vaporizer assembly 110 and is introduced into apparatus 10 of the present invention. Usually, the flow rate of the vaporized molecules into apparatus 10 is about 1 to about 2500 microliter per minute, preferably, about 50 to about 100 microliters per minute. An RF voltage of appropriate intensity is applied to RF coil 32 sufficient to induce a plasma in a gas sealed within chamber 22 of apparatus 10.

The plasma emits UV radiation that is transmitted through the wall of tubular element 12 and into passageway 20 to ionize the vaporized molecules produced in nebulizer/vaporizer assembly 110. Accordingly, as discussed in detail above, the applied RF voltage must be strong enough to yield UV radiation in the induced plasma sufficient to ionize the vaporized molecules.

Chamber 101 is preferably operated substantially at or near atmospheric pressure, that is, typically from about 660 torr to about 860 torr, preferably, at or about 760 torr. Operation above or below atmospheric pressure is possible and may be desirable in certain applications. Chamber 101 is a closed chamber, that is, chamber 101 is substantially enclosed and separated from or sealed with respect to the outside or external environment but which does not necessarily provide a liquid or gas tight seal. In a preferred embodiment, chamber 101 provides liquid and/or gas tight sealing from the outside or external environment.

The sample is ionized in apparatus 10 under the influence of the UV radiation. The ions are optionally desolvated under the influence of a drying gas induced in space 170 around capillary assembly 115. The ions exit chamber 101 by means of entrance opening 180 to capillary assembly 115 and subsequently enter into vacuum and/or mass analyzer 120, where they are subjected to mass analysis. A detector, in conjunction with the mass analyzer, detects the ions that have been subjected to mass analysis.

The data from the mass analysis discussed above may be communicated to a computer for read-out or other processing. Any computer may be employed such as, for example, an IBM® compatible personal computer or clone (PC), an APPLE® computer, various workstations and the like. The computer is driven by appropriate software.

The results from the mass spectroscopic analysis as described above may be forwarded to a remote location. By the term "remote location" is meant a location that is physically different than that at which the results are obtained. Accordingly, the results may be sent to a different room, a different building, a different part of city, a different city, and so forth. Usually, the remote location is at least about one mile, usually, at least ten miles, more usually about a hundred miles, or more from the location at which the results are obtained. The method may further comprise transmitting data representing the results. The data may be transmitted by standard means such as, e.g., facsimile, mail, overnight delivery, e-mail, voice mail, and the like.

The present apparatus and method may be employed in applications other than the primary ion source in a mass spectrometer, especially in any situation where ions are to be produced from molecules that are flowing through the lamp. For example, the lamp may surround an ion guide at less than atmospheric pressure, e.g., about 0.5 to about $10^{-2}$ torr, so that the UV photons can ionize molecules within the guide. In general, the discharge plasma shields the inner region from the electric fields of the lamp so that operation of the ion guide is substantially unaffected by those fields.

All publications and patent applications cited in this specification are herein incorporated by reference as if each individual publication or patent application were specifically and individually indicated to be incorporated by reference.

Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims. Further, it is apparent from the disclosure herein that the present invention is not limited to the specific embodiments described. Such changes and modifications mentioned above, though not expressly described or mentioned herein, are nonetheless intended and implied to be with in the spirit and scope of the invention.

What is claimed is:

1. An ion source for a mass spectrometer, comprising:

(a) a vapor source that produces a directed stream of vaporized molecules within said ion source; and (b) an ultraviolet lamp, adjacent said vapor source, that surrounds a portion of the stream so that the stream flows through the lamp;

wherein said stream is not exposed to an electrode in the portion surrounded by the ultraviolet lamp as it flows through said lamp.

2. An ion source according to claim 1 wherein said ion source is at substantially atmospheric pressure.

3. An ion source according to claim 1, further comprising ions in said stream created by photoionization of said vaporized molecules with ultraviolet radiation from the lamp.

4. An ion source according to claim 1, wherein the ultraviolet lamp comprises:

(a) a tubular outer element;

(b) a tubular inner element disposed within said outer element to provide a space between said outer element and said inner element, said inner element being open at its ends to provide a pathway therethrough that includes a region through which said stream flows.

5. An ion source according to claim 4 that further comprises means for totally enclosing said space.

6. An ion source according to claim 5 that further comprises a gas in said space.

7. An ion source according to claim 6 wherein said gas comprises a noble gas.

8. An ion source according to claim 6 wherein said gas comprises nitrogen.

9. An ion source according to claim 6 further comprising an RF electric field in said space that excites the gas.

10. An ion source according to claim 6 further comprising a DC electric field in said space that excites the gas.

11. An ion source according to claim 6 further comprising a microwave electric field in said space that excites the gas.

12. An ion source according to claim 4 wherein the tubular inner element comprises a material that is substantially transparent to ultraviolet radiation.

13. An ion source according to claim 12 wherein said material is selected from the group consisting of magnesium fluoride, lithium fluoride, calcium fluoride and sapphire.

14. A mass spectrometer system comprising:

(a) a vapor source that produces a directed stream of vaporized molecules;

(b) an ultraviolet lamp, adjacent said vapor source, that surrounds a portion of said stream so that the stream flows through the lamp; and (c) a mass analyzer system with an inlet adjacent said stream downstream from the ultraviolet lamp;

wherein said stream is not exposed to an electrode in the portion surrounded by the ultraviolet lamp as it flows through said lamp.

15. A method for ionization of molecules in an ion source for mass spectrometry, comprising:

(a) producing a directed stream of vaporized molecules;

(b) flowing the stream through a region surrounded by an ultraviolet lamp within said ion source;

wherein said stream is not exposed to an electrode while flowing through the region surrounded by the ultraviolet lamp.

16. The method of claim 15 further comprising the step of ionizing a portion of the vaporized molecules within the region by means of ultraviolet radiation from said lamp.

17. A method for mass spectrometry analysis of a sample containing analyte, comprising:

(a) producing a directed stream of vaporized molecules;

(b) flowing the stream through a region surrounded by an ultraviolet lamp within said ion source without exposing said stream to an electrode while flowing through said region;

(c) ionizing a portion of the vaporized molecules within the region by means of ultraviolet radiation from said lamp, thereby creating ions, and (d) analyzing a portion of said ions with a mass spectrometer.

18. An ion source for a mass spectrometer comprising:

(a) a vapor source that produces a directed stream of vaporized molecules; and (b) an ultraviolet lamp, adjacent said vapor source, that surrounds a portion of said stream so that the stream flows through the lamp, said ultraviolet lamp further having a reflective surface operative to increase an intensity of radiation directed toward the surrounded portion of said stream.

19. The ion source of claim 18, wherein said ion source is at atmospheric pressure.

20. The ion source of claim 18, further comprising ions in said stream created by photoionization of said vaporized molecules with ultraviolet radiation from the lamp.

21. A mass spectrometer system comprising:

a) a vapor source that produces a directed stream of vaporized molecules;

b) an ultraviolet lamp, adjacent said vapor source, that surrounds a portion of said stream so that the stream flows through the lamp, said ultraviolet lamp further having a reflective surface operative to increase an intensity of radiation directed toward the surrounded portion of said stream; and (c) a mass analyzer system with an inlet adjacent said stream downstream from the ultraviolet lamp.

22. The mass spectrometer system of claim 21, wherein the stream is at atmospheric pressure upstream from the mass analyzer.

23. A method for ionization of molecules in an ion source for mass spectrometry, comprising:

(a) producing a directed stream of vaporized molecules;

(b) flowing the stream through a region surrounded by an ultraviolet lamp within said ion source; and (c) reflecting emissions of said ultraviolet lamp, initially directed away from the stream, toward the stream so as to increase exposure of the vaporized molecules to ultraviolet radiation.

24. The method of claim 23, further comprising the step of ionizing a portion of the vaporized molecules within the region by means of the ultraviolet radiation.

* * * * *